United States Patent [19]

Gebhard et al.

[11] Patent Number: 4,944,117

[45] Date of Patent: Jul. 31, 1990

[54] FOOTHOLD SECURITY GATE

[75] Inventors: Albert W. Gebhard, Denver; Roy E. Knoedler, Boulder; Robert M. Parker, Aurora; William G. Au, Northglenn, all of Colo.

[73] Assignee: Gerico, Inc., Denver, Colo.

[21] Appl. No.: 238,621

[22] Filed: Aug. 30, 1988

[51] Int. Cl.[5] ..... E06B 7/00

[52] U.S. Cl. ..... 49/55; 49/57

[58] Field of Search ..... 49/50, 57, 59, 465, 49/141; 160/225; 292/37, 41, 83

[56] References Cited

U.S. PATENT DOCUMENTS

| | | | |
|---|---|---|---|
| 2,756,469 | 7/1956 | Cattermole et al. . | |
| 2,896,277 | 7/1959 | Halligan . | |
| 3,120,032 | 2/1964 | Burnette | 49/141 |
| 3,489,201 | 1/1970 | Curry et al. | 160/225 |
| 4,470,277 | 9/1984 | Uyeda . | |
| 4,607,455 | 8/1986 | Bluem et al. . | |

*Primary Examiner*—Kenneth J. Dorner
*Assistant Examiner*—Gerald A. Anderson
*Attorney, Agent, or Firm*—Sheridan, Ross & McIntosh

[57] ABSTRACT

A closure is provided that is directed, in the preferred embodiment, to an adjustable gate suitable for confining or preventing small children or pets from entering a secure area. The preferred embodiment of the gate is comprised of two connected panels that are relatively slidable to accommodate doorways of varying width. A thumb screw arrangement is used to fix the relative positions of the panels when roughly adjusting the gate to a particular doorway. Once the gate is roughly adjusted to the doorway a foot-pedal mechanism residing in one of the panels is employed to cause a pair of contact pads to engage the door jamb. As the foot pedal is depressed the contact pad blocks associated with one side of the gate and the bumpers associated with the opposite of the gate engage opposite sides of the door jamb. Further, depression of the foot pedal causes an increasing normal force to be applied to the door jamb that frictionally fixes or wedges the gate in the door jamb. The foot-pedal mechanism employs a presser panel having inclined surfaces that cooperate with ramped surfaces on the contact pad blocks to force the contact pad blocks into contact with the door jamb. The forces of the contact pad blocks against the door jamb is maintained by a releasable ratchet mechanism which allows the foot-pedal and hence the presser panel to be depressed but prevents any upward movement. The ratchet mechanism incorporates a release mechanism which allows the foot-pedal and presser panel to move upward thereby reducing the force of the inclined surfaces against the contact pad blocks and releasing the gate from the door jamb.

11 Claims, 10 Drawing Sheets

FOOTHOLD SECURITY GATE

FIELD OF THE INVENTION

The present invention relates to closures and, in particular, is directed to a gate useful for confining or preventing small children or pets from leaving or entering a secure area.

BACKGROUND INFORMATION

Typically, it is desirable to confine small children or pets to a secure area. Conversely, it may be advantageous to prevent small children or pets from entering a hazardous area. For example, since small children require virtually constant attention to prevent them from getting into injurious situations an adult may find it useful to confine the child to a room free from hazards while attending to other chores.

Previous approaches to this problem have included providing gates that, typically, adjust to doorways of varying width and that incorporate some sort of mechanism that both fixes the gate in place and is extremely difficult, if not impossible, for a child or pet to release. U.S. Pat. No. 2,756,469 issued Jul. 31, 1956 to Cattermole et al. for a "Barrier for a Doorway are the Like" discloses a single panel door gate that can be adjusted to doorways of varying width by extending the bumpers associated with each side of the gate. Rough adjustment of the gate to a doorway is accomplished by adjusting the extension of the bumpers on one side of the gate using a spring-loaded lock pin type of arrangement. The bumpers on the other side of the gate engage the doorway using a rack and pinion type of arrangement. The pinion element includes a rotatable handle wherein the handle can be locked in place to one of the rails associated with the gate. Upon rotation of the handle, the bumpers associated with both sides of the gate apply a normal force to the door jamb which frictionally fixes the gate in place.

U.S. Pat. No. 2,896,277 issued Jul. 28, 1959 to Halligan for a "Gate Structure" discloses a single panel gate that is adjustable to fit doorways of varying width. Width adjustment is achieved by adjusting the upper bumper on one side of the gate using a notched-rod device. Adjustment of the opposing upper bumper by a threaded rod and lever mechanism fixes the upper pair of bumpers in the doorway. Halligan then employs a rotating foot pedal to move a pair of bumpers into engagement with the floor thereby securing the gate.

A more recent door gate is discussed in U.S. Pat. No. 4,607,455 issued Aug. 26, 1986 to Bluem et al. for an "Adjustable Gate for Doorways". Bluem, in contrast to the prior patents, discloses a two-panel gate that is adjusted to fit in a doorway by a crank and rack assembly. By turning the crank the panels slide relative to one another thereby allowing the gate to fit doorways of varying width. Once roughly adjusted and placed in the doorway, further cranking results in a wedging-type action which fixes the gate in place.

A closure mechanism for a safe is disclosed in U.S. Pat. No. 4,470,277 issued Sept. 11, 1984 to Uyeda for a "Security Door Lock Mechanism". Uyeda discloses a safe-locking mechanism which utilizes a rotating handle located on the outside of the door to linearly translate a slotted panel located on the inside of the door. Fitted into the slots are dowels that are, in turn, attached to posts which engage holes in the walls of the safe thereby preventing the safe door from being opened.

Translation of the slotted panel in one direction serves to force the posts into the holes thereby locking the door. The forces thus provided to the dowels are off-set from the post movement axes and, in this sense are not colinear therewith. Translation of the slotted panel in the opposite direction retracts the pins from the holes thereby unlocking the door.

Previous approaches to providing a security gate have been subject to a number of disadvantages. Previous devices have required somewhat difficult or awkward locking mechanisms such as separate or manual locking of a handle or crank. At least partially because of this, in a typical device, placement of the device requires use of two hands which can be inconvenient when, for example, carrying an infant. Similarly, disengagement or removal of previous devices typically require release, unlocking or manipulation of a handle in an awkward fashion often requiring the use of two hands for removal of the security gate.

Accordingly, there is a need for a security gate which is easily installable, preferably requiring no more than a single handed installation, and easily removable, preferably removable with no more than single hand operation. Further, it is desirable to provide a security gate which has efficient operation so that forces sufficiently transmitted to the friction components, does not require drilling or making holes in door jambs, is easily adjustable to accommodate a range of widths of doorways, and can be conveniently repositioned when not in use.

SUMMARY OF THE INVENTION

The preferred embodiment of the present invention employs a first panel slidably joined to a second panel. The sliding engagement between the first and second panels allows the panels to be positioned to accommodate doorways of varying width. A pair of thumb screws is employed to fix the panels at a width that roughly accommodates the selected doorway. The first panel includes a first vertical outside member having a first pair of laterally extending bumpers for contacting a first side of the door jamb. The second panel includes a second vertical outside member having a second pair of bumpers which can be moved laterally outward such that the first and second pairs of bumpers apply a normal force to the first and second sides of the door jamb thereby frictionally fixing or wedging the gate in place. The second pair of bumpers can also be retracted to release the gate. The lateral displacement of the second pair of bumpers is achieved by a mechanism, preferably foot actuated, housed in the second vertical outside member.

The mechanism, basically, employs a presser panel having inclined surfaces which cooperate with ramped surfaces on slide blocks bearing the second pair of bumpers to outwardly, laterally displace the second pair of bumpers when a foot pedal, attached to the presser panel, is depressed. The outward displacement of the second pair of bumpers causes the first and second pair of bumpers to apply a normal force to the door jamb which fixes the gate in place. Upward movement of the presser panel, which would allow the second bumpers to retract, is prevented by a releasable ratchet. Consequently, once an operator depresses the foot pedal, the ratchet operates to maintain the position of the presser panel which, in turn, maintains the pressure of the presser panel inclined surfaces on the ramped surfaces of the slide blocks thereby maintaining the normal force of the bumpers against the door jamb. Maintenance of the normal force is thus automatic, i.e., it does not require further manual latching, locking or other manipulation, but instead occurs whenever the foot pedal is depressed.

The ratchet incorporates a release mechanism which, when actuated such as in conjunction with a slight depression of the foot pedal, automatically moves the presser panel upward. A spring, preferably, is employed to upwardly displace the presser panel when the release mechanism of the ratchet is actuated thus eliminating the need for two-handed removal. Upward displacement of the presser panel relieves the pressure of the inclined surfaces on the second pair of bumpers. Consequently, the normal force that frictionally fixes the gate in the door jamb is eliminated and the gate can be released from the door jamb. Release of the normal force and movement away from the door jamb is, thus, automatic, i.e. without requiring additional manipulation such as unlocking or unlatching a handle, but occurs upon activation of a release mechanism.

The present invention, in the preferred embodiment, also provides for a pair of optional bracket mounts should the user want to pivot the gate instead of completely removing it from the doorway. The bracked mounts are located on the first vertical outside member of the gate, to cooperate with a pair of brackets attached to the door jamb to allow the gate to swing when the gate is not in use.

Consequently, the present invention, among other advantages, provides a gate employing a closure mechanism that can be conveniently actuated, preferably without requiring hand operation or requiring only a single hand, from either side of the gate. Another advantage of the gate is that it can be easily adjusted to accommodate doorways having a broad range of widths. A further advantage provided by the present invention is that the gate when not in use does not have to be placed off to one side of the doorway. In addition, the gate comprising the present invention employs a closure mechanism which is convenient, efficient, easy to operate and securely fixes the gate in a doorway.

DETAILED DESCRIPTION OF THE PREFERRED EMBODIMENT

Figure 1:
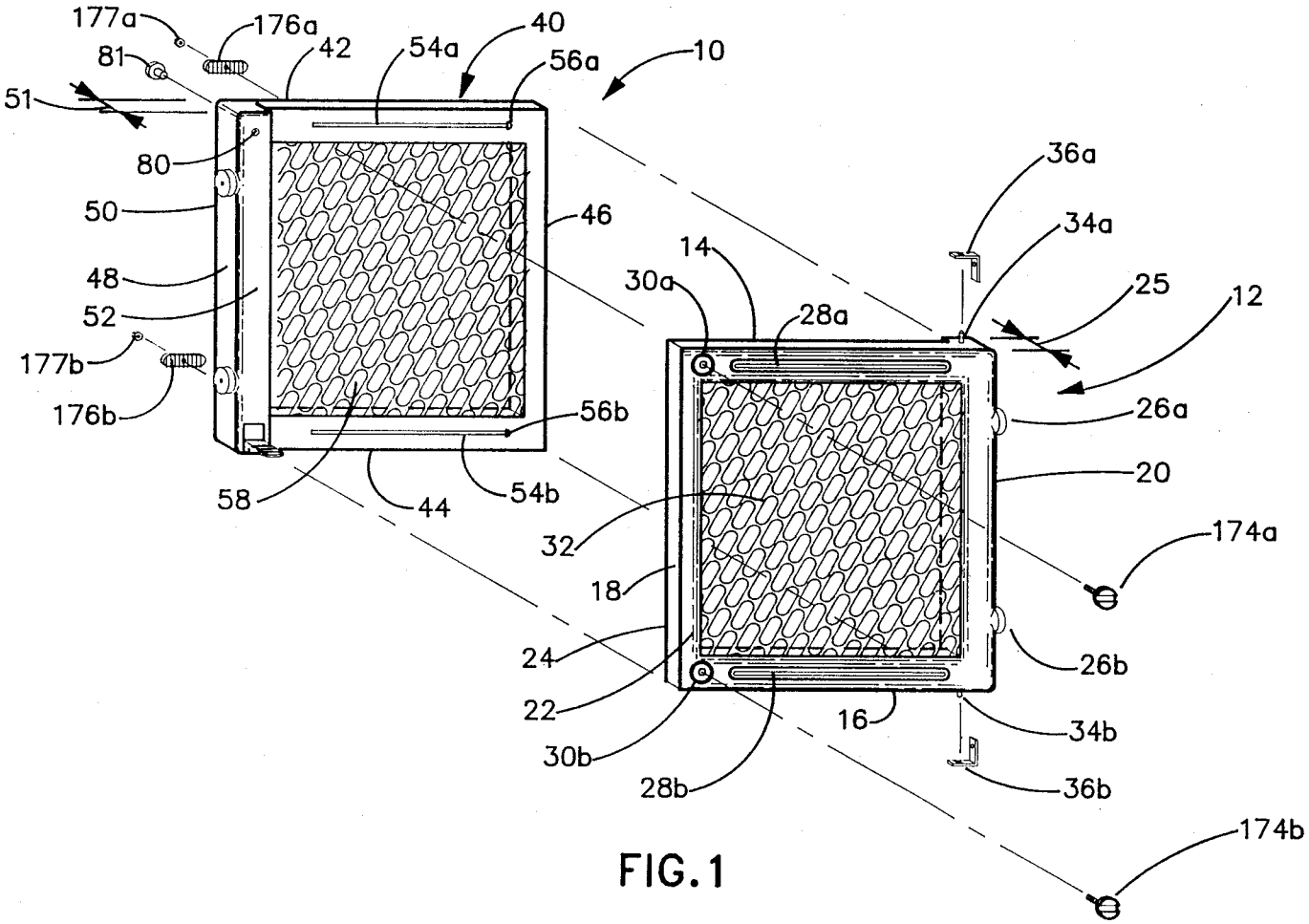
FIG. 1 is an exploded perspective view of a two-panel gate that employs the preferred embodiment of the invention.

With reference to FIG. 1, the preferred embodiment of the present invention a foothold security gate 10, hereinafter gate 10, suitable for confining pets, children and the like to particular rooms or areas by blocking doorways or other exit paths is disclosed. The main structural and screen portion of the gate 10 are preferably constructed of a durable, molded plastic that is lightweight, easy to clean and capable of withstanding rough treatment. The plastic construction of gate 10 also provides several desirable safety features. For example, a child or pet can gnaw or chew on a plastic gate without ingesting toxic chemicals, like paint or lacquer. Furthermore, a plastic gate, unlike a wooden gate, does not splinter. Among the other safety features incorporated into the gate 10 are rounded edges to reduce the chance of injury when a child or pet comes into contact with the gate.

With reference to FIG. 1, the preferred embodiment of the present invention includes a first panel 12 that is comprised of a first upper member 14 connected to a first lower member 16 by a first inside member 18 and a first outside member 20. The first panel is further defined to have a first exterior side 22 and a first interior side 24. The width 25 of the first outside member 20 is approximately twice that of the other members comprising the first panel 12 for reasons that will be discussed later. The first outside member 20 includes top and bottom holes (not shown) for mounting a first pair of bumpers **26*a*, 26*b* that extend laterally outwards from the first outside member 20 to engage a door jamb or like structure. The bumpers 26*a*, 26*b* are, preferably, made of rubber to prevent marring of the door jamb while also providing excellent frictional contact between the gate 10 and the door jamb. The first upper member 14 and the first lower member 16 each have, respectively, longitudinally extending first slots 28*a*, 28*b* with shoulder portions (not shown) recessed from the first exterior side 22 for use in connecting the first panel 12 to a second panel. The shoulder is dispensed with for a small portion of the first slots 28*a*, 28*b* located near the first inside member 18 in order to facilitate the engagement of the first panel 12 to a second panel. Located approximately at the corners defined by the intersection of the first upper member 14 and the first lower member 16 with the first inside member 18 are a pair of thumb screw holes 30a, 30b for receiving thumb screws used to engage the first panel 12 with a second panel. The thumb screw holes 30a, 30b also have shoulder portions (not shown) recessed from the first exterior side 22. A first screen 32 for allowing a substantially unobstructed view from one side of the gate 10 to the other side of the gate 10 occupies the space defined between the first upper member 14, first lower member 16, the first inside member 18 and the first outside member 20. Optionally, a pair of bracket mounts 34a, 34b, for engaging brackets mounted on a door jamb or similar structure, extend vertically upward and downward from the top and bottom sides, respectively, of the first outside member 20. The bracket mounts 34a, 34b in cooperation with a pair of brackets 36a, 36b mounted to the door jamb allow the gate 10 to swing when not in use thereby avoiding the necessity of manually placing the gate 10** off to one side of the doorway, or otherwise storing.

The second panel 40 is comprised of a second upper member 42 connected to a second lower member 44 by a second inside member 46 and a second outside member 48. The second panel 40 is further defined to have a second exterior side 50 and a second interior side 52. Further, the width 51 of the second outside member 48, like the first outside member 20, is approximately twice that of the other members comprising the second panel 40. Second upper member 42 and second lower member 44 each have, respectively, longitudinally extending second slots 54a, 54b with shoulder portions 53 recessed from the second exterior side 50 for use in connecting the second panel 40 to the first panel 12. Located at the corners defined by the intersection of the second upper member 42 and the second lower member 44 with the second inside member 46 are a pair of capstans 56a, 56b extending outward from the second interior surface 52 and used to engage the second panel 40 with the first panel 12. A second screen 58 for allowing a substantially unobstructed view from one side of the gate 10 to the other side of gate 10 resides in the space defined intermediate the second upper member 42, the second lower member 44, the second inside member 46 and the second outside member 48.

Figure 3:
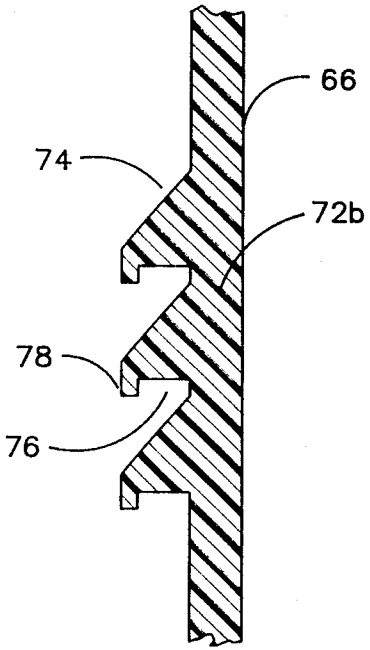
FIG. 3 is a cross-sectional view of the ratchet teeth located in the interior of the second vertical outside member of the second gate panel.
Figure 2:
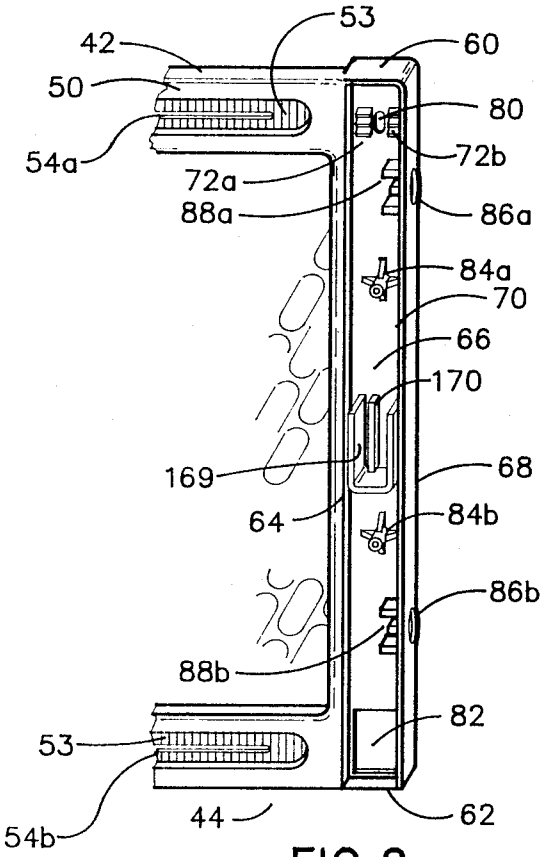
FIG. 2 is a partial perspective view illustrating elements of the closure mechanism housed within the interior of the second vertical outside member of the second gate panel.

With reference to FIG. 2, the second outside member 48 is comprised of a top wall 60 connected to a bottom wall 62 by a first side wall 64, second side wall 66 and third side wall 68 which define a hollow interior 70. The hollow interior 70 houses a foot-activated mechanism which fixes the gate in a doorway or similar structure. Located near the top wall 60 on the interior side of the second side wall 66 are a pair of first ratchet teeth 72a, 72b for cooperating with a catch block, a part of the foot-activated mechanism described below. With reference to FIG. 3, the first ratchet teeth 72b have leading edges 74 directed toward the top wall 60 and trailing edges 76 and directed toward the bottom wall 62. The first ratchet teeth 72a, 72b are further characterized by downward-directed first sub-teeth 78 which, in cooperation with similar structures associated with a catch block, insure against accidental release of the ratchet as discussed hereinafter. Referring again to FIG. 2, a hole 80 which accommodates a button 81 for releasing the first ratchet teeth 72a, 72b from a catch block separates ratchet teeth 72a from ratchet teeth 72b. A substantially rectangular hole 82 for receiving a foot pedal extends through the second side wall 66 near the bottom wall 62. Intermediate the first ratchet teeth 72a, 72b and the rectangular hole 82 and extending normal to the interior surface of the second side wall 66 are a pair of tapped stanchions 84a, 84b for mounting a presser panel, a portion of the foot-activated mechanism. Stanchion 84a serves the further purpose of providing a mount for a one end of a spring used in connecting a presser panel to the second outside member 48 as described below. Intermediate stanchion 84a and the first ratchet teeth 72a, 72b, and intermediate stanchion 84b and the rectangular hole 74, respectively, are a pair of circular holes 86a, 86b extending through the third side wall 68 with complementary guide surfaces 88a, 88b connected to the interior surfaces of the second side wall 66 and the third side wall 68. The guide surfaces 88a, 88b are for confining a pair of contact blocks while the circular holes 86a, 86b are for allowing a portion of the contact blocks to extend laterally away from the second outside member 48 and thereby engage a door jamb or similar structure.

Figure 4A:
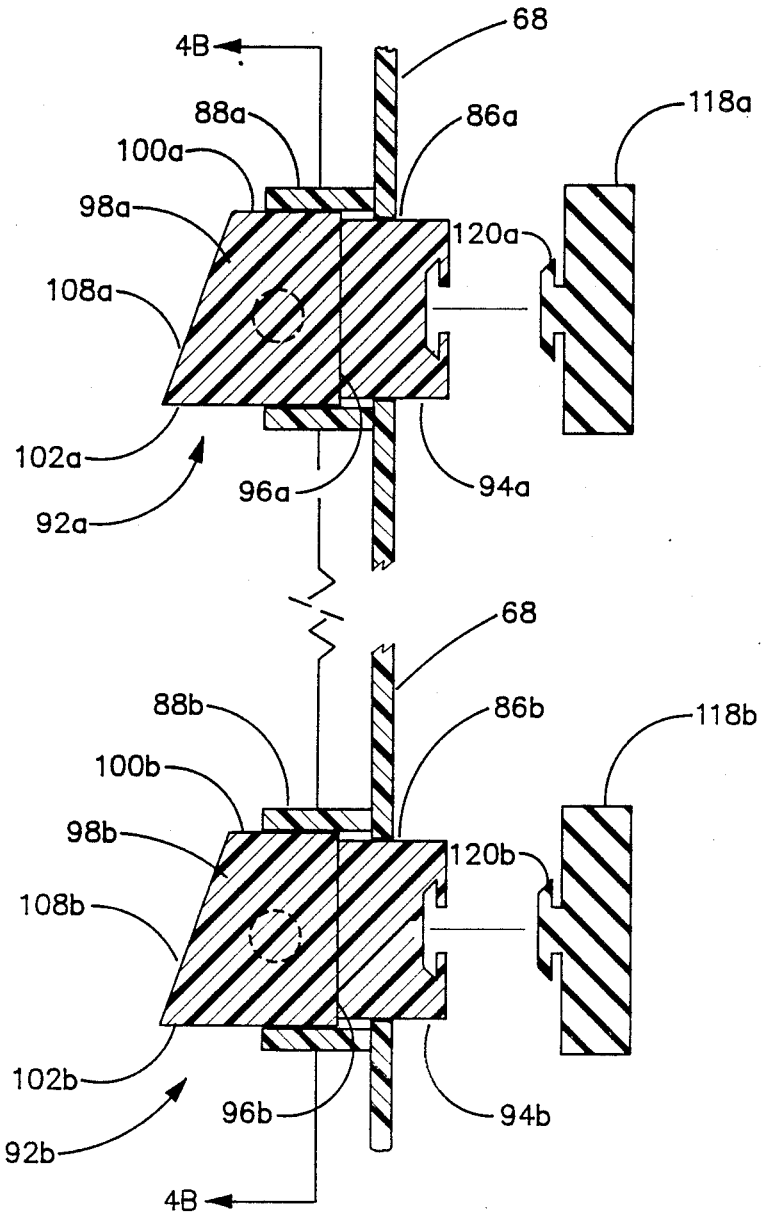
FIG. 4A is a longitudinal cross-section illustrating the relationship of the contact pad blocks to the guide surfaces and walls associated with the second vertical outside member.
Figure 4B:
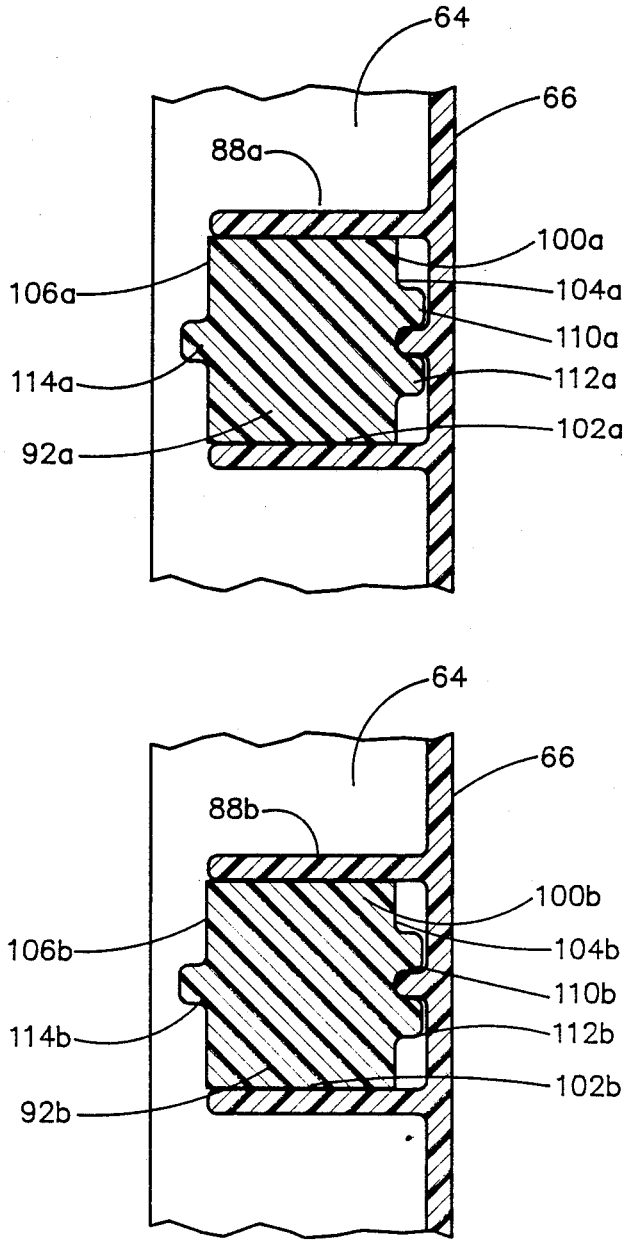
FIG. 4B is a longitudinal cross-section similar to that of FIG. 4A but along a plane perpenducular to that of FIG. 4A, illustrating the relationship of the contact pad blocks to the guide surfaces and walls associated with the second vertical outside member.

Included in the present invention, with reference to FIGS. 4A and 4B, are a pair of contact pad blocks 92a, 92b for engaging a door jamb on the side opposite from bumpers 26a, 26b. Contact pad blocks 92a, 92b are comprised of a cylindrical portion 94a, 94b operatively connected at shoulders 96a, 96b to ramped portions 98a, 98b. The cylindrical portions 94a, 94b of the contact pad blocks 92a, 92b extend as far as shoulders 96a, 96b will allow, through circular holes 86a and 86b, respectively. The ramped portions 98a, 98b are comprised of top surfaces 100a, 100b, bottom surfaces 102a, 102b, first side surfaces 104a, 104b, second side surfaces 106a, 106b and ramped surfaces 108a, 108b. The top surfaces 100a, 100b and bottom surfaces 102a, 102b cooperate with guide surfaces 88a, 88b to vertically constrain the contact pad blocks 92a, 92b. Referring to FIG. 4B, the first side surfaces 104a, 104b have first ribs 110a, 110b and second ribs 112a, 112b for, among other reasons, minimizing the surface of contact, and hence the friction, between the contact pad blocks 92a, 92b and the second side wall 66. The second side surfaces 106a, 106b have nubbins 114a, 114b which, among other things, similarly minimize the contact surface between the contact pad blocks and an interior surface of a presser panel. Friction is further minimized by, preferably, constructing the contact pad blocks 92a, 92b of Teflon or other material having a low coefficient of friction. The nubbins 114a, 114b also cooperate with an inclined surface in the presser panel to retract the contact pad blocks 92a, 92b when the gate 10 is not in use. Furthermore, the first ribs 110a, 110b and second ribs 112a, 112b contact with the second side wall 66 in conjunction with the nubbins 114a, 114b contact with a presser panel further restricts the contact pad blocks 92a, 92b to lateral movement. Referring again to FIG. 4A, lateral displacement of the contact pad blocks 92a, 92b is achieved by inclined surfaces associated with a presser panel contacting ramped surfaces 108a, 108b. Contact pads 118a, 118b for contacting the door jamb, preferably made of rubber, are attached by flange portions 120a, 120b to the cylindrical portion 94a, 94b of the contact pad blocks 92a, 92b protruding from the circular holes 86a, 86b.

Figure 5:
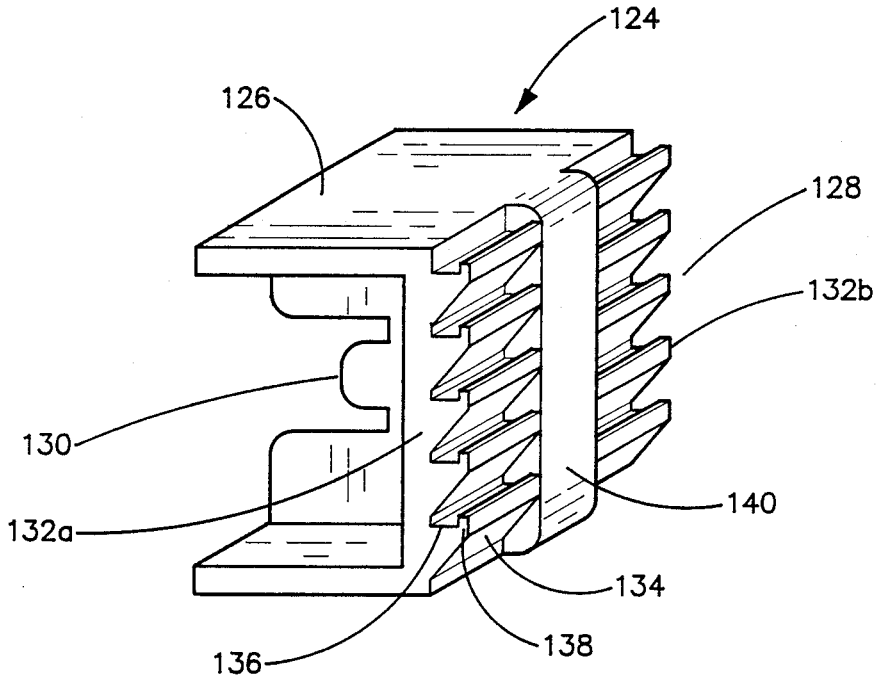
FIG. 5 is a perspective view of the catch block.
Figure 6:
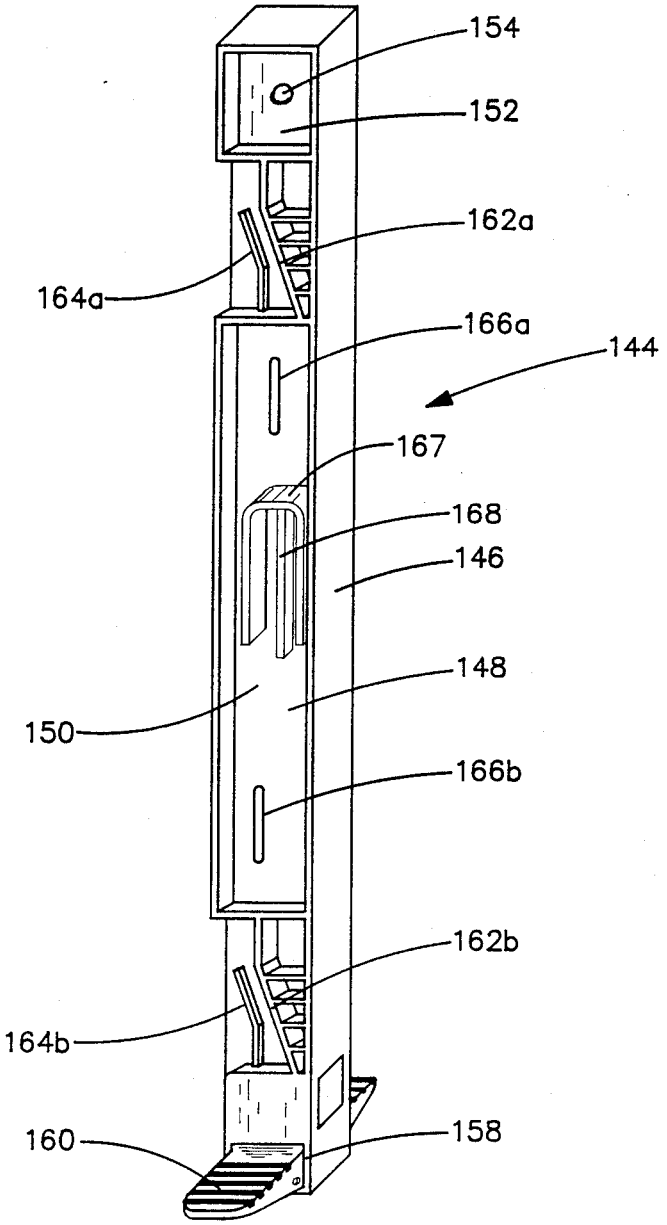
FIG. 6 is perspective view of the presser panel.

Also included in the present invention, with reference to FIG. 5, is a catch block 124 for cooperating with the first ratchet teeth 72a, 72b and the button 81. The catch block 124 is comprised of a U-shaped body 126 having a contact face 128 and a first spring-attachment portion 130. The contact face 128 is further comprised of second ratchet teeth 132a, 132b for engaging the first ratchet teeth 72a, 72b in a ratchet-like fashion in the assembled gate 10. The second ratchet teeth 132*a*, 132*b* having downward leading edges 134, and upward facing trailing edges 136 and sub-teeth 138. When operatively engaged, the second ratchet teeth 132*a*, 132*b* allow the catch block 124 to be downwardly displaced relative to the first ratchet teeth 72*a*, 72*b* while preventing any upward displacement. In a similar fashion the first sub-teeth 78 and second sub-teeth 138 prevent any lateral displacement of the catch block 124 relative to the first ratchet teeth 72*a*, 72*b*. Second ratchet teeth 132*a* and 132*b* are separated by a release surface 140 which cooperates with the button 81 to laterally displace the catch block 124 relative to the first ratchet teeth 72*a*, 72*b* thereby facilitating disengagement of the first ratchet teeth 72*a*, 72*b* from the second ratchet teeth 132*a*, 132*b* and allowing the catch block 124 to be downwardly displaced. The first spring-attachment portion 130 provides a connecting point for one end of a spring that biases the catch block 124 into contact with the first ratchet teeth 72*a*, 72*b*. The button 81 upon contacting release surface 140 compresses the spring thereby facilitating disengagement the first ratchet teeth 72*a*, 72*b* and the second ratchet teeth 132*a*, 132*b*.

Gate 10 further includes, with reference to FIGS. 6, 7A, 7B, 8A, 8B, 9A and 9B a presser panel 144 for cooperating with the structures resident in the second outside member 48 and the catch block 124 to laterally displace the contact pad blocks 92*a*, 92*b*. The presser panel 144 is comprised of a side wall 146 and an exterior wall 148 which define an interior 150. The exterior face of the presser panel side wall 146 contacts the interior surface of first side wall 64 when the presser panel 144 is operatively connected to the second outside member 48. The exterior wall 148, when the presser panel 144 is in place, substantially closes the open side of the second outside member 48. Furthermore, the length of presser panel 144 less than the length of the second outside member 48 thereby allowing the presser panel 144 to be vertically displaced within the second outside member 48. The interior 150 includes a catch block housing 152 with a second spring attachment point 154. When the presser panel 144 is operatively connected to the second outside member 48 one end of a spring 156 is connected to the second spring attachment point 154 while the other end is connected to the first spring attachment point 130 associated with catch block 124. The spring 156 biases the second ratchet teeth 132*a*, 132*b* into engagement with the first ratchet teeth 72*a*, 72*b*. The interior 150 of the presser panel 144 also includes a pedal attachment section 158 for attaching a foot pedal 160 to the presser panel 144. Foot pedal 160 extends both through the hole 82 and outward from the exterior wall 148 thereby allowing the presser panel 144 to be actuated from either side of the gate 10. Intermediate the catch block housing 152 and the pedal attachment section 158 are a pair of primary inclined surfaces 162*a*, 162*b* and a pair of secondary inclined surfaces 164*a*, 164*b*. Primary inclined surfaces 162*a*, 162*b* contact the ramped surfaces 108*a*, 108*b* of the contact pad blocks 92*a*, 92*b*. Consequently, upon downwardly displacing the presser panel 144 the primary inclined surfaces 162*a*, 162*b* act to outwardly, laterally displace the contact pad blocks 92*a*, 92*b*. Secondary inclined surfaces 164*a*, 164*b* are positioned intermediate the nubbins 114*a*, 114*b* and the third side wall 68. Consequently, the secondary inclined surfaces 164*a*, 164*b* function to inwardly, laterally displace the contact pad blocks 92*a*, 92*b* upon upward displacement of the presser panel 144. A pair of slots 166*a*, 166*b*, located intermediate the inclined surfaces, extend through exterior wall 148 and align with the stanchions 84*a*, 84*b*. A pair of screws with washers (not shown) connect the presser panel 140 to the stanchions 84*a*, 84*b* while slots 166*a*, 166*b* allow vertical displacement of the presser panel 144. An inverted U-shaped spring seat 167 with a central recessed leg 168 cooperates with a U-shaped spring seat 169 and leg 170 formed in the hollow interior 70 of the third sidewall 68 to define a seat for a spring 171 used to bias the presser panel 144 vertically upwards. The spring 171 is substantially relaxed when the presser panel 144 is upwardly displaced and compressed when the presser panel 144 is downwardly displaced.

Referring again to FIG. 1, the capstans 56*a*, 56*b* projecting outward from the second interior side 52 of the second panel 40 are inserted through, from the first interior side 24 of the first panel 12, the first slots 28*a*, 28*b* at the point where there is no shoulder. The head of the capstans 56*a*, 56*b* then abuts against the shoulder of the first slots 28*a*, 28*b* thereby providing a sliding engagement between the first panel 12 and the second panel 14. A pair of thumb screws 174*a*, 174*b* having heads which engage the shoulders of thumb screw holes 30*a*, 30*b* and threaded portions which project from the first interior side 24 are inserted through, from the second interior side 52 of the second panel 40, slots 54*a*, 54*b*, through sliders 176*a*, 176*b* and engage nuts 177*a*, 177*b*. Sliders 176*a*, 176*b* include toothed or ridged surfaces which abut the shoulder portions 53 of the second slots 54*a*, 54*b* which are similarly toothed or ridged, as seen in FIG. 2. The thumb screws 174*a*, 174*b* in cooperation with the sliders 176*a*, 176*b* can be tightened to bring into engagement the toothed surfaces of the sliders 176*a*, 176*b* and the shoulder portions 53 of the second slots 54*a*, 54*b*, so as to increase the friction between the abutting first interior side 24 and second interior side 52. Consequently, the capstans, slots and thumb screws all cooperate to provide a fixable sliding engagement between the first panel 12 and the second panel 40 that allows a broad range of doorways or like structures to be accommodated by the gate 10. The minimum width that can be accommodated by gate 10 being defined by the abutment of the double wide first outside member and second outside member with the first inside member and second inside member, respectively. The maximum width that gate 10 can accommodate is defined by the abutment of the thumb screw assemblies with the capstans.

Having described the various components of the gate 10 and their relationship to one another the method of using and operating the gate 10 with reference to FIGS. 8A, 8B, 9A and 9B will be described. Operation of the gate 10 can be broken down into two basic operations. Namely, fitting the gate 10 to a doorway and the operation of the closure mechanism.

Figure 10:
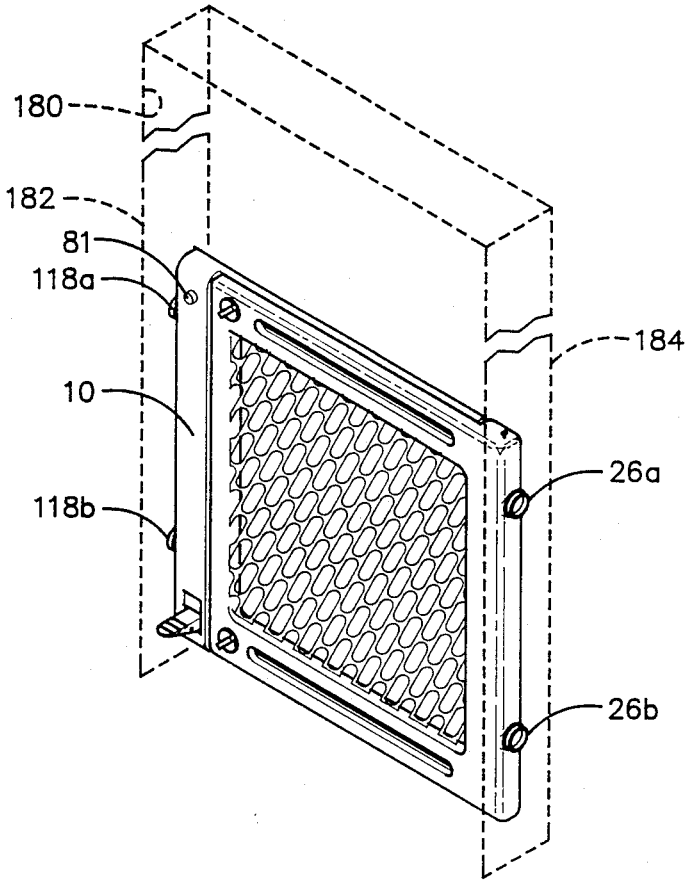
FIG. 10 is a perspective view of the assembled gate according to the present invention, with an area to be gated indicated in phantom lines.

Referring now to FIG. 10, fitting the gate 10 to a doorway 180 or similar structure is accomplished by initially, preferably, verifying that the presser panel 144 is in its upward-most position. If the presser panel 144 is not in its upward-most position then the spring 170 will be stretched and the second ratchet teeth 132*a*, 132*b* of the catch block 124 will be engaging the first ratchet teeth 72*a*, 72*b* of the second outside member 40. Furthermore, when the presser panel 144 is not in its upward-most position the primary inclined surfaces 162*a*, 162*b* will be forcing the contact pad blocks 92*a*, 92*b* laterally, outward from the second outside member 40.

Figure 7A:
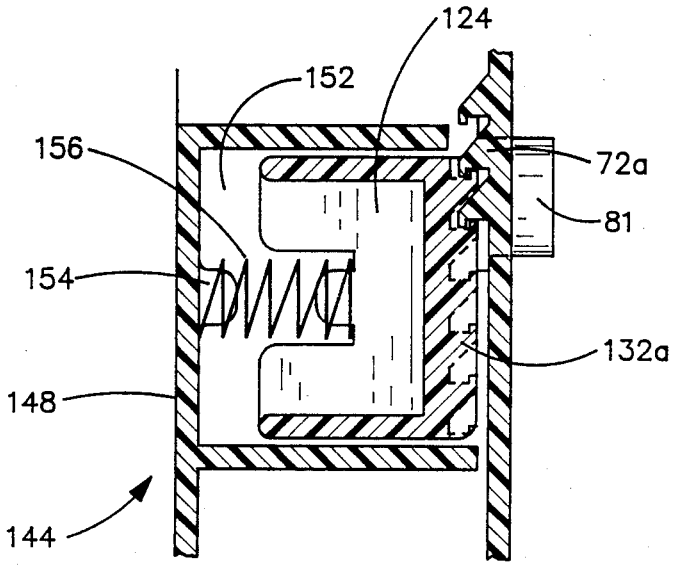
FIG. 7A is a cross-sectional view illustrating the ratcheting mechanism that employs the catch block.
Figure 7B:
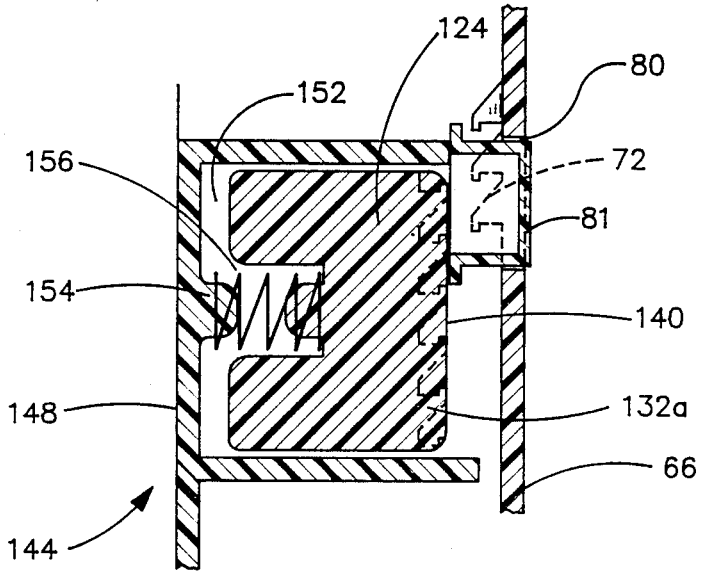
FIG. 7B is a cross-sectional view illustrating the release of the ratcheting mechanism that employs the catch block.
Figure 8A:
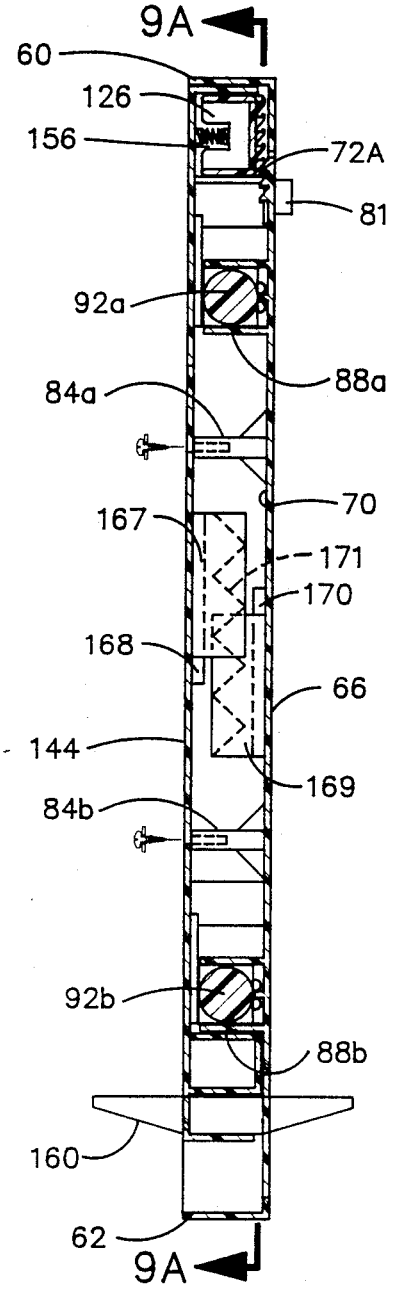
FIG. 8A is a longitudinal cross-sectional view of the closure mechanism with the presser panel in its upward-most position.
Figure 8B:
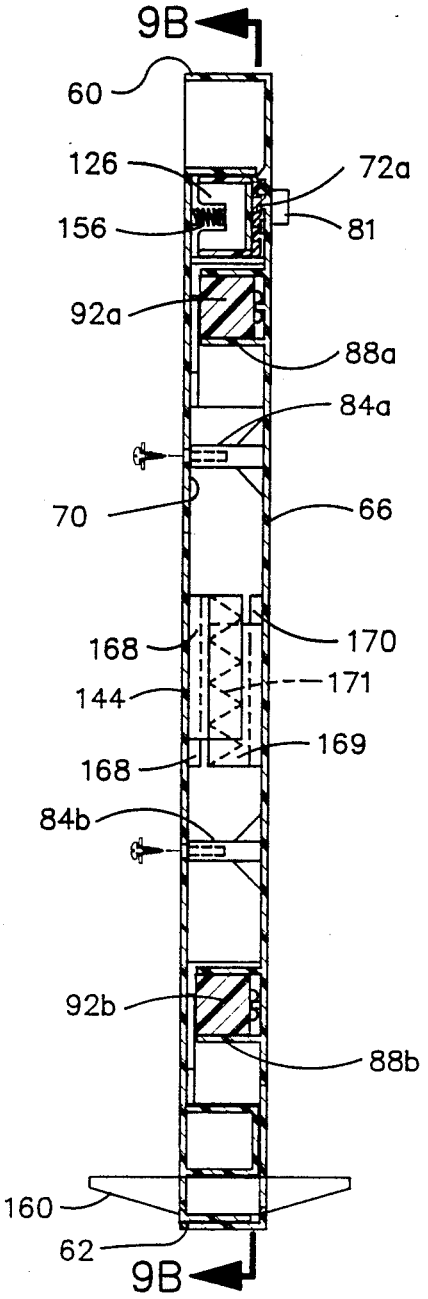
FIG. 8B is a longitudinal cross-sectional view of the closure mechanism with the presser panel in its downward-most position.
Figure 9A:
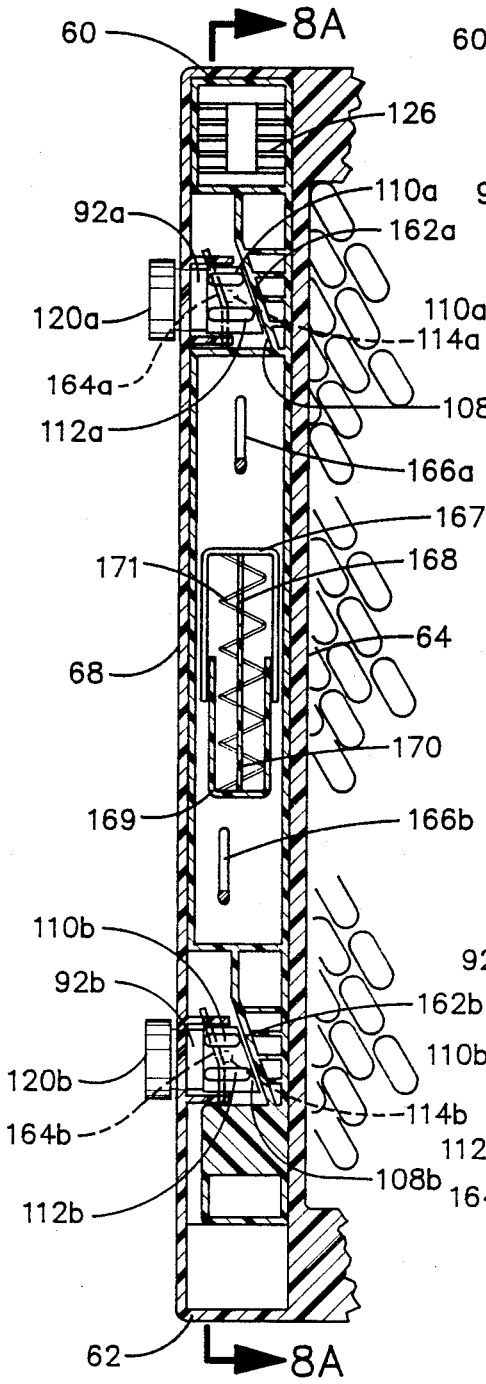
FIG. 9A is a longitudinal cross-sectional view along a plane perpendicular to that of FIG. 8A of the closure mechanism with the presser panel in its upward-most position.
Figure 9B:
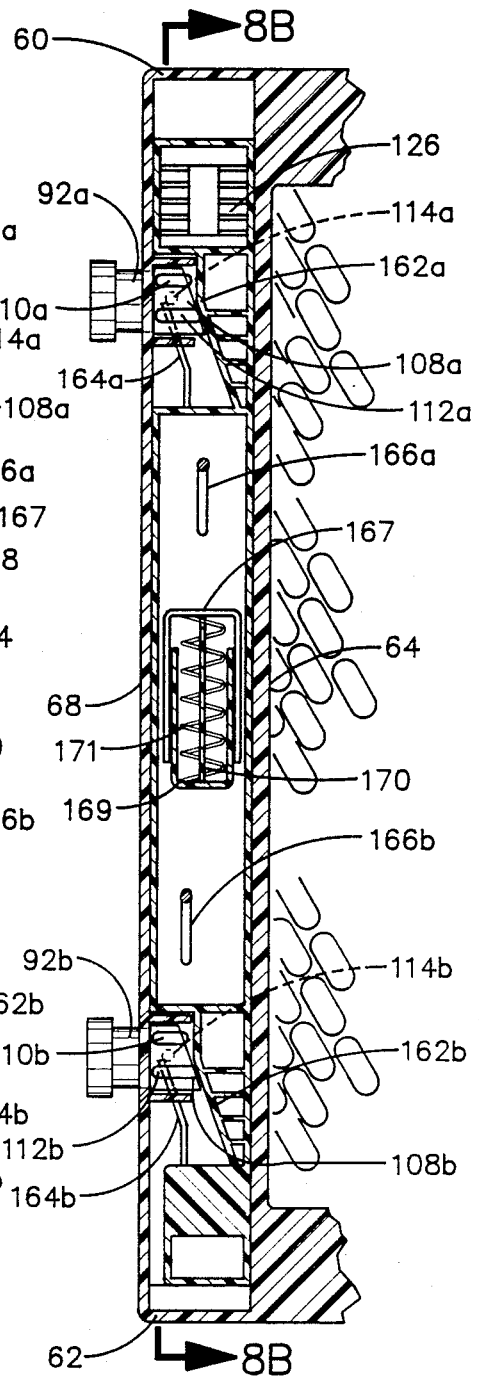
FIG. 9B is a longitudinal cross-sectional view along a plane perpendicular to that of FIG. 8B of the closure mechanism with the presser panel in its upward-most position.

Referring to FIG. 7B, the presser panel 144 is placed in its upward-most position by depressing button 81 which, in turn, contacts the release surface 140 of the catch block 124 thereby compressing the spring 156 and partially disengaging the second ratchet teeth 132*a*, 132*b* from the first ratchet teeth 72*a*, 72*b*. Disengagement is completed by depressing the foot pedal 160 to disengage the first sub-teeth 78 from the second sub-teeth 138. Upon disengagment of the ratchet teeth the spring 170 forces the presser panel 144 to its upward-most position. The upward movement of the presser panel 144 causes the secondary inclined surfaces 164*a*, 164*b* to engage the nubbins 114*a*, 114*b* and thereby retract the contact pad blocks 92*a*, 92*b*.

Having assured that the contact pad blocks 92*a*, 92*b* are fully retracted the gate 10 is adjusted to roughly fit the doorway 180 or similar structure. Rough adjustment of the gate 10 is accomplished by first making sure that the thumb screws 174*a*, 174*b* are loose enough to allow the first panel 12 and the second panel 40 to slide relative to one another. The first panel 12 and second panel 40 are then adjusted, by sliding one relative to the other, such that the distance between, for example, bumper 26*a* and contact pad 118*a* corresponds to the distance between similar points on the opposite sides 182, 184 of a door jamb. Notably, the double width of the first outside member 20 and the second outside member 48 allow the bumpers 26*a*, 26*b* and the contact pads 118*a*, 118*b* to engage the opposing door jambs 184, 182 respectively at points that define a plane that is approximately normal to the planes defined by the opposing door jambs 182, 184. Once roughly adjusted the thumb screws 174*a*, 174*b* are tightened to prevent any sliding of the first panel 12 relative to the second panel 40 and vice versa.

Optionally, the gate 10 can be mounted to the door jamb using the bracket mounts 34*a*, 34*b* and the brackets 36*a*, 36*b*. By mounting the gate 10 to the door jamb the gate 10 can swing when not engaged with the door jambs thereby avoiding the necessity of having to place the gate 10 off to one side of the doorway when not in use.

Closure, after having both adjusted the gate 10 to fit the doorway and placing the presser panel 144 in its upward-most position, involves depressing the foot-pedal 160. Depressing the foot-pedal 160 has several consequences. First, the primary inclined surfaces 162*a*, 162*b* of the presser panel 144 cooperate with the ramped surfaces 108*a*, 108*b* of the contact pad blocks 92*a*, 92*b* to force the contact pads 118*a*, 118*b* and the bumpers 26*a*, 26*b* laterally outward to engage a door jamb 182 or similar surface. Once the contact pads 118*a*, 118*b* engage the door jamb further depressing of the foot-pedal 160 causes an increasingly larger normal force to be applied by bumpers 26*a*, 26*b* and contact pads 118*a*, 118*b* to opposite sides of the door jamb. The normal force, in effect, wedges or frictionally fits the gate 10 in the doorway. Second, depression of the foot-pedal 160 and the downward movement of the presser panel 144 causes the second ratchet teeth 132*a*, 132*b* of the catch block 124 to engage the first ratchet teeth 72*a*, 72*b*. Due to the orientation of the leading and trailing edges associated with the first ratchet teeth 72*a*, 72*b* and the second ratchet teeth 132*a*, 132*b* downward movement of the presser panel 140 is unimpeded whereas upward movement of the presser panel is prevented. Consequently, by limiting the presser panel 144 to downward movement the catch block 124 operates to insure that the gate 10 remains wedged in the door jamb 180. Third, as the presser panel 144 is moved downward the spring 171 is compressed. The spring 171 when compressed operates to, among other things, oppose the downward movement of the presser panel 144. Consequently, the compressed spring 171 forces the trailing edges of the ratchet teeth against one another to insure that the presser panel 144 cannot move upwards. Further, the compressed spring 171 operates to store the energy necessary to return the presser panel 144 to its upward-most position when the gate 10 is released, as described hereinafter.

Release of the gate 10 is accomplished by depressing both the button 81 and the foot-pedal 160. Referring to FIG. 7B, the button 81, upon being depressed, contacts the release surface 140 of catch block 124 thereby moving the catch block 124 away from the first ratchet teeth 72*a*, 72*b*. However, this movement is limited by the first sub-teeth 78 engaging the second sub-teeth 138. Consequently, a slight vertical displacement is necessary to disengage the sub-teeth. The vertical displacement is achieved by depressing the foot-pedal 160 which, in turn, moves the presser panel 144 and the catch block 124 downward also. Requiring both the button 81 and the foot-pedal 160 to be depressed to release the gate operates as a safety feature to prevent small children or animals from releasing the gate. Once the ratchet-like engagement between the first ratchet teeth 72*a*, 72*b* and the catch block 124 is released the energy stored in the stretched spring 170 causes the presser panel 144 to move upward. The upward movement of the presser panel 144, in turn, causes the secondary inclined surfaces 164*a*, 164*b*, by engaging the nubbins 114*a*, 114*b*, to retract the contact pad blocks 92*a*, 92*b*. Retraction of the contact pad blocks 92*a*, 92*b*, in turn, disengages the contact pads 118*a*, 118*b* from the door jamb 182. Consequently, the gate 10 is no longer wedged or frictionally fixed in the door jamb.

As will be apparent to those skilled in the art a number of variations of the described embodiment are possible. For example, all or portions of the gate can be constructed of materials other than molded plastic including, e.g., formed plastic, wood, rubber, fiberglass, resin, or metal. A clutch mechanism could be utilized in place of the ratchet mechanism. Further, the spring 171 could be replaced with an expansion spring, such as extending between two posts, a leaf spring or, e.g., analagous pneumatic, hydraulic or electrical devices that provide both the requisite elasticity and energy storage. In addition, the foot-activated mechanism could be replaced with mechanical elements, like cranks and levers, or electrical elements, like motors, which are capable of achieving the same translation of the presser panel. Also, the double ramped surface/inclined surface arrangement described herein could be replaced with a single or multiple ramped surface/inclined surface arrangement if necessary or suitable. The button 81 could be replaced with a flexible tongue.

What is claimed is:

1. A friction-mountable security gate for gating an area, comprising:

panel means having a center for at least partly covering the area;

at least one block movably attached to said panel means and movable from a first position substantially proximate to said panel means to at least a second position extended in a direction away from said center of said panel means;

first means attached to said panel means for moving said block from said first position to said second position, said first means including foot activatable means wherein said block is moved from said first position to said second position in response to said foot activatable means being depressed by a foot;

second means, being activated at substantially the same time as said foot activatable means, for releasing said block from said second position;

third means for releasably locking said block in said second position wherein said block is automatically locked when said block is moved to said second position;

fourth means for moving said block by storing energy when said foot activatable means is used to move said block from said first position to said second position; and fifth means for engaging said third means and for moving said block away from said second position wherein at least part of said stored energy is used for said movement away from said second position.

2. A friction-mountable security gate, as claimed in claim 1, wherein:

said foot activatable means extends beyond the plane of said panel wherein said foot activatable means is activatable from either side of said panel means.

3. A friction-mountable security gate, as claimed in claim 1, wherein:

said third means includes a ratchet for automatically locking said block in said second position.

4. A friction-mountable security gate for gating an area between first and second surfaces, comprising:

panel means for at least partly covering the area;

at least one block movably connected to said panel means and laterally extendable from a first position proximate to said panel means in a direction towards the first surface;

activatable means movable in a substantially vertical direction and operatively engagable with said block for moving said block from said first position to contact the first surface when said activatable means is moved in substantially only said substantially vertical direction;

means operatively connected to said block for storing energy when said activatable means is moved in said substantially vertical direction; and lock means for locking said activatable means after said block has been laterally extended and said activatable means has moved in said vertical direction.

5. A friction-mountable security gate, as claimed in claim 4, wherein: said means for storing energy includes a spring.

6. A friction-mountable security gate, as claimed in claim 4, further comprising:

release means for unlocking said lock means and for automatically moving said activatable means away from said extended position wherein at least part of said stored energy is used for said movement away from said extended position.

7. A friction-mountable security gate, as claimed in claim 4, wherein:

said activatable means is foot-actuated.

8. A friction-mountable security gate, as claimed in claim 4, wherein:

said lock means includes a ratchet for locking said activatable means in said extended position.

9. A friction-mountable security gate for gating an area, comprising:

panel means having a center for at least partly covering the area;

at least one block attached to said panel means and movable from a first position substantially proximate said panel means to at least a second position extended in a direction away from the center of said panel means;

first means attached to said panel means for moving said block from said first position to said second position;

second means, operatively connected to said block, for storing energy when said first means moves said block from said first position to said second position;

third means for automatically locking said block in said second position, said third means including a ratchet for automatically locking said block in said second position; and fourth means for releasably unlocking said third means and for automatically moving said block away from said second position wherein at least part of said stored energy is used for said automatic movement away from said second position.

10. A friction-mountable security gate, as claimed in claim 9, wherein:

said first means includes a foot-activated pedal.

11. A friction-mountable security gate, as claimed in claim 9, wherein:

said second means includes a spring.

* * * * *